US007731521B2

(12) United States Patent
Corradi et al.

(10) Patent No.: US 7,731,521 B2
(45) Date of Patent: Jun. 8, 2010

(54) DEVICE FOR ELECTRICAL CONNECTION OF DISCONTINUOUS CONDUCTORS

(75) Inventors: Vincenzo Corradi, Desio (IT); Mauro Pasquinelli, Meda (IT)

(73) Assignee: Italgenio S.R.L., Milan (MI) (IT)

( * ) Notice: Subject to any disclaimer, the term of this patent is extended or adjusted under 35 U.S.C. 154(b) by 681 days.

(21) Appl. No.: 11/630,786

(22) PCT Filed: Jul. 19, 2005

(86) PCT No.: PCT/EP2005/007840

§ 371 (c)(1),
(2), (4) Date: Dec. 27, 2006

(87) PCT Pub. No.: WO2006/008131

PCT Pub. Date: Jan. 26, 2006

(65) Prior Publication Data

US 2009/0197455 A1 Aug. 6, 2009

(30) Foreign Application Priority Data

Jul. 20, 2004 (IT) ..... MI2004A1463

(51) Int. Cl.
*H01R 4/24* (2006.01)

(52) U.S. Cl. ..... 439/417; 439/402

(58) Field of Classification Search ..... 439/417, 439/425, 402, 404, 413
See application file for complete search history.

(56) References Cited

U.S. PATENT DOCUMENTS 2,745,065 A * 5/1956 Maher ..... 333/136
3,115,541 A 12/1963 Hanner et al.
3,718,888 A * 2/1973 Pasternak ..... 439/399
3,890,029 A * 6/1975 Izraeli ..... 439/397
3,899,236 A * 8/1975 Santos ..... 439/402
4,436,361 A * 3/1984 McCleerey ..... 439/404
4,444,449 A * 4/1984 Aysta et al. ..... 439/401
4,776,812 A * 10/1988 Boissonnet et al. ..... 439/407
4,781,615 A * 11/1988 Davis et al. ..... 439/395
4,865,564 A * 9/1989 Denkmann et al. ..... 439/404
4,897,041 A * 1/1990 Heiney et al. ..... 439/404
5,071,365 A * 12/1991 Fremgen et al. ..... 439/402

(Continued)

FOREIGN PATENT DOCUMENTS

DE 100 39 637 2/2002

(Continued)

OTHER PUBLICATIONS

International Search Report for PCT/EP2005/007840 mailed Nov. 3, 2005.

*Primary Examiner*—Michael C Zarroli
*Assistant Examiner*—Vladimir Imas
(74) *Attorney, Agent, or Firm*—Nixon & Vanderhye PC

(57) ABSTRACT

A device for electrical connection of discontinuous conductors, extending in a longitudinal direction, comprising a body made of insulating material inside which is disposed a conductor element provided with means adapted to come into contact with the conducting part of at least one respective discontinuous conductor, said body having guides for sliding of a respective slider provided with at least one relative seat extending parallel to said longitudinal direction and adapted to contain a portion of the relative discontinuous conductor, said slider being movable from a first position of extraction from the body to a second position of insertion inside said body.

14 Claims, 2 Drawing Sheets

U.S. PATENT DOCUMENTS

Figure 1:
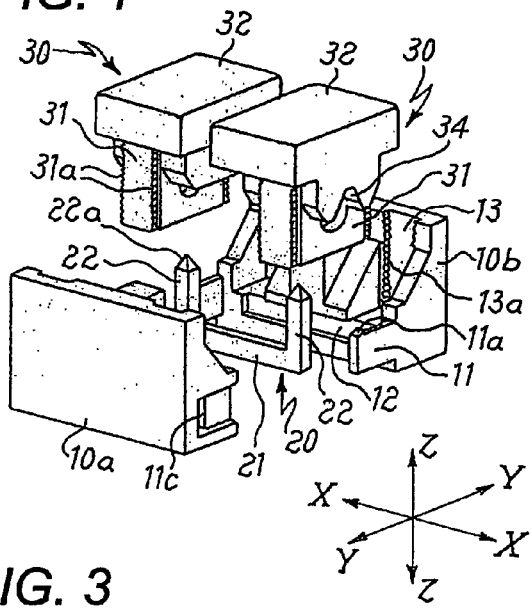

| | | | | | |
|---|---|---|---|---|---|
| 5,080,606 | A * | 1/1992 | Burkard | 439/403 |
| 5,338,220 | A * | 8/1994 | Soes et al. | 439/403 |
| 5,415,562 | A * | 5/1995 | Matsumoto et al. | 439/397 |
| 5,498,172 | A * | 3/1996 | Noda | 439/404 |
| 5,597,321 | A * | 1/1997 | Jacques | 439/417 |
| 5,622,425 | A * | 4/1997 | Lin | 362/249.01 |
| 5,762,518 | A * | 6/1998 | Tanigawa et al. | 439/409 |
| 5,820,404 | A * | 10/1998 | Chishima et al. | 439/417 |
| 5,836,791 | A * | 11/1998 | Waas et al. | 439/709 |
| 5,975,938 | A * | 11/1999 | Libby | 439/410 |
| 5,989,057 | A * | 11/1999 | Gerke et al. | 439/417 |
| 6,159,035 | A * | 12/2000 | Smith, III | 439/391 |
| 6,305,967 | B1 * | 10/2001 | Smith, III | 439/391 |
| 6,315,595 | B1 * | 11/2001 | LaPorte et al. | 439/412 |
| 6,328,592 | B1 * | 12/2001 | Burke et al. | 439/417 |
| 6,402,541 | B1 * | 6/2002 | Mindeau | 439/402 |
| 6,863,558 | B2 * | 3/2005 | Negishi et al. | 439/404 |
| 7,156,689 | B2 * | 1/2007 | Fabian et al. | 439/417 |
| 2005/0227529 | A1 * | 10/2005 | Mrakovich et al. | 439/402 |
| 2006/0160405 | A1 * | 7/2006 | Fabian et al. | 439/417 |

FOREIGN PATENT DOCUMENTS

| | | |
|---|---|---|
| EP | 0 834 957 | 4/1998 |
| GB | 699856 | 11/1953 |
| GB | 2 103 434 | 2/1983 |

* cited by examiner

DEVICE FOR ELECTRICAL CONNECTION OF DISCONTINUOUS CONDUCTORS

This application is the US national phase of international application PCT/EP2005/007840 filed 19 Jul. 2005, which designated the U.S. and claims priority of IT MI2004A001463, dated 20 Jul. 2004, the entire contents of each of which are hereby incorporated by reference.

DESCRIPTION

A device for electrical connection of discontinuous connectors extending in a longitudinal direction forms the subject matter of the present invention.

The need is known in the electrical network plant engineering sector to create electrical connections of discontinuous wires by means of terminals able to restore the continuity of the electrical connection and at the same time ensure mechanical retention of the conductors which must withstand pre-established longitudinal traction loads.

An example of such terminals is represented by so-called terminal strips, essentially consisting of a body made of insulating material having sunken terminals made of conducting material, connected to each and comprising a hole for insertion of a second cable in its longitudinal direction and a clamping screw for said cable acting transversally to the cable.

The most common terminal boards for electrical panels and the like are made on the same principle.

Although functional, these connecting means nevertheless have some drawbacks represented essentially by the fact that live parts (even at 220V) remain on view and accessible; it is necessary to peel the wires before inserting them in the guide for tightening of the screw, three hands must be used to join a wire, a tool (screwdriver) must be used to screw/unscrew the terminal and insert/remove the wires, making operations as a whole not always easy, particularly in awkward positions like ceiling light fittings and the like.

The technical problem therefore arises of producing a device able to make the connection of discontinuous electrical cables which is able to restore electrical continuity, to ensure a reliable mechanical retention of the conductors against longitudinal traction forces, and does not have live elements in a position that is accessible, even accidentally, to a user.

Within the scope of problem, such a device is also required to be of limited size, easy and cheap to produce and easy to use even for inexperienced personnel without the need for additional tools.

These results are achieved according to the present invention by a device for electrical connection of discontinuous conductors extending in a longitudinal direction, having the characteristics of appended independent claim 1. Advantageous embodiments are apparent from the dependent claims.

The device according to the invention comprises a body made of insulating material inside which is disposed a conducting element provided with means able to enter into contact with the conducting part of at least one respective discontinuous conductor, said body having guides for sliding of a respective slider provided with at least one relative seat extending parallel to said longitudinal direction and adapted to contain a portion of the relative discontinuous conductor, said slider being mobile from a first position of extraction from the body to a second position of insertion inside said body.

Figure 2:
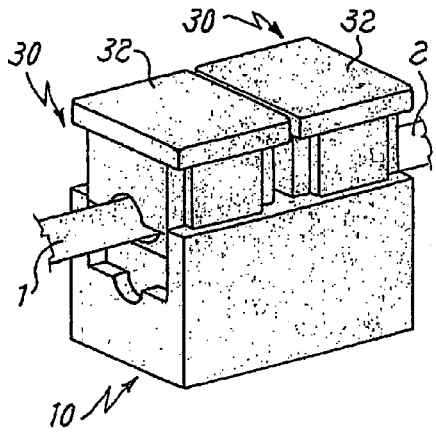
Figure 3:
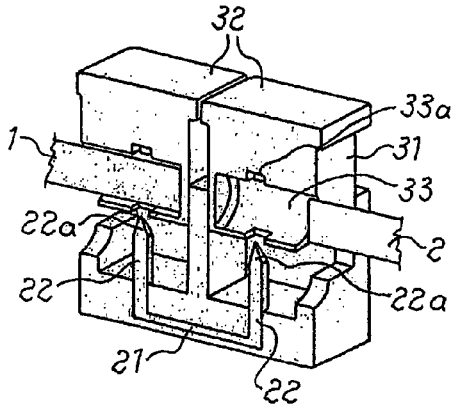
Figure 4:
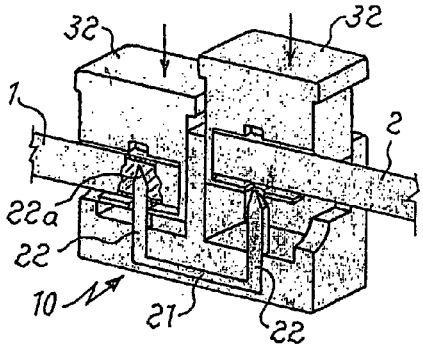
Figure 5:
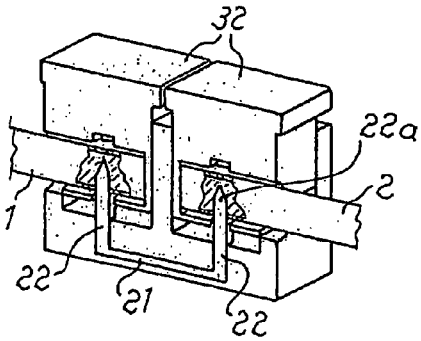
Figure 6:
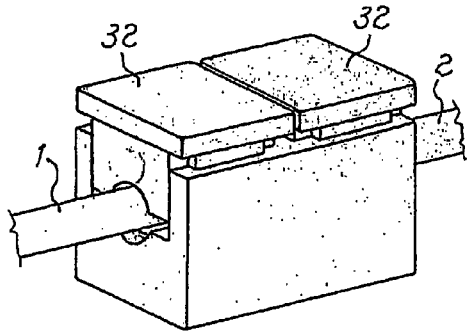

Greater details can be obtained from the following description of non-limiting embodiments of the subject matter of the present invention made with reference to the appended drawings, which show:

FIG. 1: an exploded view of the device according to a first embodiment of the present invention;

FIG. 2: a perspective view of the device of FIG. 1 assembled, open and during insertion of the wires;

FIG. 3: a diagrammatic, perspective, partially sectional view of the device of FIG. 2;

FIG. 4: a partially sectional diagrammatic view of the device during blocking of the first wire;

FIG. 5: a partially sectional, perspective diagrammatic view of the device after blocking of the two wires and FIG. 6: a perspective view of a device once installation has been completed.

Figure 7:
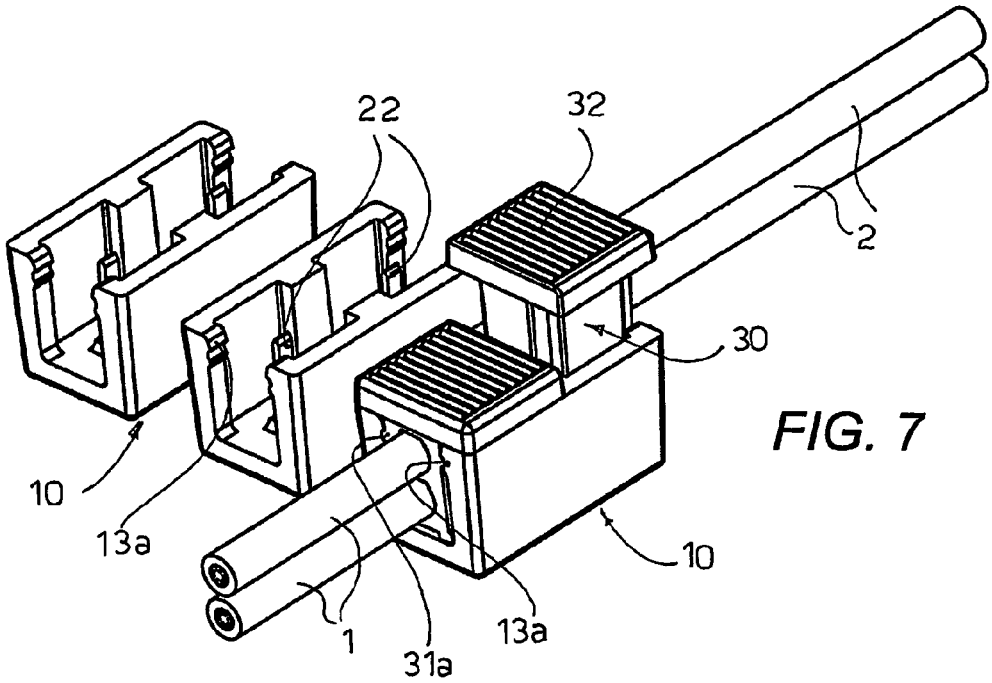
Figure 8:
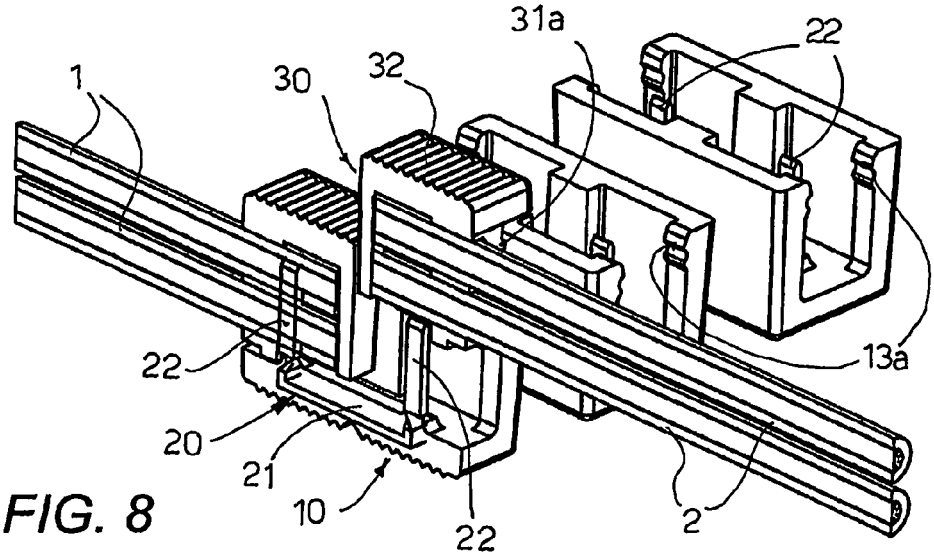

FIG. 7: a perspective diagrammatic view of a device according to a second embodiment of the invention, for connection of two discontinuous conductors;

FIG. 8: a perspective diagrammatic view of the device of FIG. 7, taken at 180° with respect to FIG. 7, showing a section taken along the median plane of the conductors.

With reference to FIGS. 1 to 6, the connecting device according to the first embodiment of the present invention comprises a body 10 made of insulating material formed by two half shells 10*a* and 10*b* which can be coupled together in a transverse direction Y-Y, at right angles to a longitudinal direction X-X parallel to the longitudinal direction of the wires 1 and 2 to be inserted in the device (henceforth referred to as terminal for brevity's sake).

In more detail, said transverse coupling of the two half shells 10*a* and 10*b* can be carried out by means of an elastic element 11 extending transversally from one, 10*b*, of the two half shells and provided with a hook part 11*a* able to enter a corresponding guide 11*c* of the other half shell, 10*a*.

The two half shells, 10*a*, 10*b*, further define a guide 12 inside which is housed an element 20 able to determine electrical continuity between the two wires 1 and 2 connected by means of the terminal. In the embodiment illustrated, said conductor element 20 is substantially U-shaped with a base 21 extending longitudinally and branches 22 extending in a direction Z-Z at right angles to the plane defined by the longitudinal direction X-X and the transverse direction Y-Y. The free end of each branch 22 of the "U" advantageously has a tip 22*a* which, as will be more obvious hereafter, is adapted to facilitate penetration of the branch 22 of the conductor element 20 into the respective wire 1 or 2.

Inside each half shell 10*a*, 10*b* are also formed suitable guides 13 designed, once the two half shells 10*a*, 10*b* are coupled, to form a guide for sliding in a direction parallel to the direction Z-Z of a slider 30 designed to form the mechanical locking and retaining element of the respective wire 1, 2.

In more detail, said slider 30 has a body 31 geometrically equivalent to the guide 13 inside which must slide a head 32 with a larger surface adapted to allow the slider 30 to be pushed towards the tip 22*a* of the conductor element 22 and to form an end of stroke abutment for said slider. In a preferred embodiment the guide 13 has one or more saw-tooth racks 13*a* adapted to couple with a corresponding rack 31*a* of the body 31 of the slider; the orientation of the saw teeth being such as to allow sliding of the slider 30 towards the inside of the body 10 and prevent the opposite outward movement of said slider.

In the body 31 of each slider 30 there is further formed a substantially circular guide 33 extending longitudinally and outwardly open to allow insertion in the longitudinal direction of the respective wire 1, 2 into the guide 33.

In a suitable diametrical position, the guide 33 further presents apertures 33*a* aligned with the axis of the branches 22 of the conductor element 20 and with such an aperture as to allow the passage of the relative branch 22 through said aperture.

On the outer surface at right angles to the longitudinal direction of insertion of the wire, the body 31 of the slider further presents an upturned V-shaped flare 34 able to guide the slider 30 on the respective wire 1, 2.

With reference to FIGS. 3 to 6, operation of the device according to the invention is as follows:

- in normal conditions the terminal has the sliders 30 raised outwards (FIG. 3); in this condition easy insertion of the conductors 1, 2 into the respective longitudinal guide 33 (FIG. 3) is allowed without the need for prior stripping of the conductors;
- once the conductors 1 and 2 have been inserted into the respective guide 33, a suitable force is exerted on the head 32 of the relative slider 30, determining descent thereof toward the inside of the body 10 and
- pushing of the wires 1 and 2 against the tips 22*a* of the branches 22 of the U-shaped conductor element 20; the tips, by penetrating inside the respective wire 1, 2, establish the electrical continuity thereof.

It can therefore be seen how the device according to the present invention allows the electrical continuity to be restored through connection of the conductor wires without the need the peel them, without the need for auxiliary tools and without parts subject to electrical voltage being accessible from the outside.

Although described in relation to a single form for connection of two opposed wires (1, 2), the terminal according to the present invention can also be realized:

- in a single form with a halved body (10) and a single clampimg slider (30) to form an integral part of devices such as electrical plugs and/or sockets (per se conventional and therefore not illustrated) which have on the outside the head of the slider 30 and the aperture of the longitudinal guide 33 for insertion of the respective conductors 1,2;
- in the multiple form of terminals to be applied to electrical boards and/or panels and/or the like;

allowing insertion of the wires and electrical connection with great speed and ease even by non specialised users.

FIGS. 7 and 8 show a second embodiment of the device according to the invention, for connection of a pair of discontinuous conductors or wires 1, 2.

In this embodiment, like or corresponding elements to those of the embodiment of FIGS. 1-6 are denoted by the same reference numerals and will not be further described. Only the parts that are structurally different from those of the previous embodiment will be briefly illustrated.

In this case, the body 10 of the device is made in a single piece, rather than in two pieces that can be coupled together, and is shown connected to identical bodies so as to form a terminal board.

Since two pairs of discontinuous wires 1, 2 are to be connected, each slider 30 has two superimposed guides or holes 33 to house the end of the respective pairs of wires 1 and 2. The U-shaped-conductor element 20 remains unchanged, and has the base 21 sunken into the base of the body 10 and the branches 22 which penetrate the respective pairs of wires 1 and 2, when the sliders 30 are lowered into the operating position. In this manner, each branch 22 of the conductor element 20 establishes electrical continuity between the pair of wires 1 and the pair of wires 2, respectively, and the base 21 of the conductor element 20 establishes electrical continuity between the pair of wires 1 and the pair of wires 2.

In this embodiment the racks 13*a*, 31*a* are replaced by opposed teeth 13*a*, 31*a* which ensure firm locking of the slider 30 in the body 10 and at the same time make it possible to disassemble the terminal, if desired.

The invention claimed is:

1. A device for electrical connection of discontinuous penetrable conductors, extending in a longitudinal direction comprising a body of insulating material inside which is disposed a U-shaped conductor element with branches substantially parallel to one direction at right angles to said longitudinal direction, said conductor element being provided with means adapted to enter into contact with and penetrate the conducting part of at least one respective discontinuous conductor, said body having guides for sliding in said direction of a respective slider movable from a first position in which it is extracted from the body to a second position in which it is inserted inside the body, characterized in that said branches of the conductor element have an end shaped into a pointed tip and in that each slider is provided with at least one relative guide extending parallel to said longitudinal direction and able to contain a portion of the relative discontinuous conductor, said guide having apertures in a diametrical position, aligned with the axis of the branches of the conductor element and of such a size as to allow the passage of the relative branch of the conductor element, so that the movement of said slider from said first position in which it is extracted from the body to said second position in which it is inserted inside the body causes said tips of the branches of the U-shaped conductor element to penetrate the conducting part of the respective conductor, establishing the electrical continuity thereof, wherein means adapted to lock the slider in said second position of insertion inside the body are provided, said locking means comprising pairs of opposed teeth, provided respectively in the body and on the slider.

2. A device according to claim 1, characterized in that said body is made in a single piece.

3. A device according to claim 1, characterized in that said body made of insulating material is formed by two half shells and which can be coupled together in a transverse direction by means of suitable relative constraining means.

4. A device according to claim 3 characterised in that said constraining means comprise an elastic element extending transversally outward from one of the two half shells provided with a hook part adapted to enter into a corresponding guide of the other half shell.

5. A device according to claim 1 characterised in that said slider has a body geometrically equivalent to a respective guide formed in the body and a head with a larger surface than said body.

6. A device according to claim 1 characterised in that said longitudinal guides of the slider have a substantially circular section open towards the outside.

7. A device according to claim 1 characterised in that on the outer surface thereof at right angles to the longitudinal direction of insertion of the wire, the body of the slider further has an upturned V-shaped flare designed to guide the slider on the respective wire.

8. A device according to claim 1 characterized in that said opposed teeth are shaped as saw teeth, so as to allow sliding of the slider towards the inside of the body, and to prevent return thereof to the initial position.

9. A device according to claim 1 characterized in that it is connected to identical devices so as to form a terminal board.

10. An apparatus of the electrical type designed for coupling with electrical wires characterized in that it comprises at least one device for electrical connection of the conductors according to claim 1.

11. An apparatus according to claim 10 characterized in that it is a plug.

12. An apparatus according to claim 10 characterized in that it is a socket.

13. A device for electrical connection of discontinuous conductors, extending in a longitudinal direction comprising a body of insulating material inside which is disposed a U-shaped conductor element with branches substantially parallel to one direction at right angles to said longitudinal direction, said conductor element being provided with means adapted to enter into contact with the conducting part of at least one respective discontinuous conductor, said body having guides for sliding in said direction of a respective slider movable from a first position in which it is extracted from the body to a second position in which it is inserted inside the body, characterized in that said branches of the conductor element have an end shaped into a tip and in that each slider is provided with at least one relative guide extending parallel to said longitudinal direction and able to contain a portion of the relative discontinuous conductor, said guide having apertures in a diametrical position, aligned with the axis of the branches of the conductor element and of such a size as to allow the passage of the relative branch of the conductor element, so that the movement of said slider from said first position in which it is extracted from the body to said second position in which it is inserted inside the body causes the penetration of said tips of the branches of the U-shaped conductor element into the respective wire, establishing the electrical continuity thereof, locking means for locking the slider in said second position of insertion inside the body, said locking means comprising pairs of opposed teeth, provided respectively in the body and on the slider.

14. A device according to claim 13 characterized in that said opposed teeth are shaped as saw teeth, so as to allow sliding of the slider towards the inside of the body, and to prevent return thereof to the initial position.

* * * * *